US006003445A

United States Patent [19]

Coslovi et al.

[11] Patent Number: 6,003,445

[45] Date of Patent: Dec. 21, 1999

[54] RETRACTABLE CONTAINER STOP AND GUIDE ASSEMBLY FOR RAILROAD FREIGHT CARS

[75] Inventors: Ilario A. Coslovi, Burlington; Tomasz Bis, Hamilton; James Wilfred Forbes, Waterloo, all of Canada

[73] Assignee: National Steel Car Ltd., Canada

[21] Appl. No.: 08/920,548

[22] Filed: Aug. 29, 1997

[51] Int. Cl.[6] ..... B60P 1/00

[52] U.S. Cl. ..... 105/355; 105/404; 410/94

[58] Field of Search ..... 105/355, 404; 410/68, 71, 72, 77, 79, 80, 83, 84, 94, 95, 121

[56] References Cited

U.S. PATENT DOCUMENTS

| | | | |
|---|---|---|---|
| 3,415,205 | 12/1968 | Gutridge | 410/72 |
| 3,493,210 | 2/1970 | Brenner | 410/94 |
| 5,000,633 | 3/1991 | Kowalik et al. | 105/355 |
| 5,106,247 | 4/1992 | Hove et al. | 410/77 |
| 5,465,670 | 11/1995 | Butcher . | |
| 5,501,556 | 3/1996 | Butcher et al. . | |
| 5,520,489 | 5/1996 | Butcher et al. | 105/355 |
| 5,785,473 | 7/1998 | Stark | 410/94 |

FOREIGN PATENT DOCUMENTS

| | | |
|---|---|---|
| 2175440 | 4/1996 | Canada . |
| 2175445 | 4/1996 | Canada . |

*Primary Examiner*—Mark T. Le
*Attorney, Agent, or Firm*—Oldham & Oldham Co., L.P.A.

[57] ABSTRACT

There is provided an improvement for a railroad freight car for transporting containers. The car is of the type having spaced apart side structures, opposed end structures and a floor structure, all of which together define a well for receiving a plurality of containers. The well has a longitudinal direction substantially aligned with the direction of travel of the car and a transverse direction substantially normal thereto. The floor structure of the car has a container support within the well which provides a container support surface. The improvement comprises a container stop provided with the container support, the container stop having an extended position and a retracted position. The container stop is biased to the extended position by a biasing component. The extended position is defined by the container stop extending upwardly from the container support surface to present two stop surfaces within the well. The stop surfaces arrest the longitudinal translation of two of the containers when same are respectively located longitudinally on each side of the container stop and are respectively seated on the container support surface. The retracted position is defined by the container stop being retracted with respect to the container support surface when a container is placed onto the container stop, such that the stop surfaces are not presented within the well. The improvement also comprises a container guide associated with the container stop. The container guide is provided in one of the side structures, and includes a deflector which extends within the well in the transverse direction. The deflector longitudinally guides a container within the well as the container is being placed therein. The deflector is dimensioned and positioned with respect to the container stop so as to prevent both of two containers from seating onto the container stop together when each of the two containers is placed in succession within the well of the car.

12 Claims, 10 Drawing Sheets

RETRACTABLE CONTAINER STOP AND GUIDE ASSEMBLY FOR RAILROAD FREIGHT CARS

FIELD OF THE INVENTION

The present invention relates generally to the field of railroad freight cars for carrying standardized intermodal cargo containers. In particular, the present invention relates to a retractable container stop which prevents the longitudinal shifting of containers in a railroad freight car well. The present invention may preferably be used with a retractable container guide which acts in conjunction with the container stop by deflecting cargo containers into position as they are loaded into the railroad freight car well.

BACKGROUND OF THE INVENTION

The transportation of intermodal containers on railcars has been a common practice for several decades. The sizes and capacities of the containers have steadily increased in time. Intermodal cargo containers have been standardized in various lengths such as 20, 24, 40, 45, 48 and 53 feet. Intermodal cargo containers have also been standardized in various widths. Typically, available cargo containers are either 96-inch (8'0") or 102-inch (8'6") in width. Today, intermodal containers are commonly available in the following dimensions: 20'L×8'6"H×8'0"W; 40'L×8'6"H×8'0"W; 45'L×9'6"H×8'6"W; and 53'L×9'6"H×8'6"W.

Each standardized cargo container has a different total load capacity. For example, the total load capacity of a typical 20-foot cargo container is approximately 52,900 pounds, while the total load capacity of a typical 40-foot or 48-foot cargo container is approximately 67,200 pounds.

The prior art has provided a variety of railroad freight cars adapted to carry intermodal cargo containers. Typically, such railcars are capable of carrying various configurations of different sized intermodal cargo containers. At times, a stacked arrangement of such cargo containers is employed.

One type of container car in use is referred to as a well car, since it has a container-receiving well between the wheeled trucks which support each end of the well car. The body of the car is generally at a low height, with containers in the bottom tier of a double-stacked container arrangement being supported approximately 10 inches above rail in a loaded car. Examples of such well cars are provided in U.S. Pat. No. 5,465,670, issued to Butcher on Nov. 14, 1995 and assigned to the present Applicant. Yet another railcar well design is disclosed in co-pending Canadian Patent Application Serial No. 2,175,440, filed in the names of Forbes and Coslovi on Apr. 30, 1996 and also assigned to the present Applicant. In order to transport as many combinations of standardized intermodal cargo containers as possible, the well of a typical well car is generally dimensioned to receive the longest and widest cargo containers commercially available.

During transport of intermodal cargo containers by rail, lateral and longitudinal forces act upon the cargo containers. These forces may be generated during switching operations and other car or train handling procedures. Typically, cargo containers are not latched to the car structure. Such containers simply sit on container support castings, which have guide blocks and locating cones welded to their flat top surfaces. A typical container support casting is illustrated in U.S. Pat. No. 5,501,556, issued to Butcher et al. on Mar. 26, 1996 and assigned to the present Applicant. The locating cones are each adapted to be received in a corresponding opening of a corner casting or a corresponding structural member of a container. The guide block serves to guide a container longitudinally during loading of the container into the well and onto the corresponding locating cone on the container support casting. Container support castings are conventionally located at the 40-foot corner locations of the well car floor. The practice to-date in this art is to have a plain support surface centrally within the railcar well, that is, a support surface which forms part of the well car floor and which is not provided with container support castings. Generally, cargo containers placed onto the floor structure of a well car are only restrained from longitudinal shifting by the container support castings.

When a second row of cargo containers is stacked onto a first row of containers in the well of a rail car, (i.e. when containers are "double stacked") the top row of containers is secured to the bottom row of containers with connecting devices known to those in this art as inter-box connectors. These connectors join the upper four corners of the bottom row of containers to the lower four comers of the top row of containers and positively lock the containers in three directions. The lateral and longitudinal forces which act upon cargo containers during their transport results in the displacement or shifting of a container from an initial location in the container well to some other position due to the inertial or dynamic forces acting on the containers during transit. Where a container is loaded into an empty well car and the length of well portion of the well car exceeds the length of the container placed therein, longitudinal shifting of that container within the well can be expected. When a long container is stacked over two 20-foot containers, container pitching from longitudinal impacts to the well car is not an issue because the long container on top stabilizes the two lower containers. The lower 20-foot containers in such a configuration cannot readily pitch and lift off the trailing container support castings in a frontal collision of the railcar. However, the situation is quite different with double-stacked 20-foot containers. The high center of gravity of the containers, combined with their shorter 20-foot length, means that container pitching will be more prevalent in a double-stacked configuration and that the trailing ends of the containers may lift several inches off the container support castings in a frontal collision of the railcar. This increases the possibility that the trailing containers will therefore lift off the cones and slide forward, thereby impacting the lead containers. Similarly, pitching of the lead containers at the lead ends thereof will occur in rear collisions of the railcar.

To resolve the problems discussed above, a number of manually operable container stops have been disclosed which are located centrally within the railcar well and which are intended to prevent the longitudinal displacement or shifting of 20-foot containers in the well of the car. One such manually operable container stop is disclosed in U.S. Pat. No. 5,465,670, issued on Nov. 14, 1995 in the name of Butcher and assigned to the present Applicant. Another pivotable container stop is disclosed in Canadian co-pending application Serial No. 2,175,445 filed on Apr. 30, 1996 in the names of Butcher and Coslovi, which application has been assigned to the present Applicant. In these known container stops, an operator must manually activate the stop by unlocking a mechanism in the railcar sidewall to allow the stop to pivot into the well of the car. When so disposed, the stop prevents the longitudinal displacement or shifting of 20-foot containers within the well. If it is desired to employ the well of the railcar for a 40-foot container, the prior art manually operable stops must be retracted by an operator by pivotally moving the stop out of the well portion of the railcar and into its retracted position within the railcar sidewall. Otherwise, the known container stops would interfere with the loading of 40-foot or 48-foot containers.

In contrast to the known container stop devices, the present invention seeks to provide a container stop which is automatically activated to prevent the longitudinal shifting of containers in a well of a well car when containers of a certain predetermined length are loaded into the well. The container stop according to the present invention automatically retracts from the well floor structure when full-length containers, such as 40-foot to 53-foot containers are seated in the well. The automatically activated container stop preferably acts in conjunction with a container guide in the railcar sidewall which provides a protruding deflector to longitudinally deflect shorter containers, such as those having a 20-foot length, as they are lowered into the well, so that such containers are seated within the well of the railcar in such manner as not to each interfere with the operation of the retractable container stop.

SUMMARY OF THE INVENTION

According to a broad aspect of the present invention, there is provided an improvement for a railroad freight car for transporting intermodal cargo containers. The railroad freight car is of the type comprising spaced apart first and second side structures, opposed end structures and a floor structure, such that the side structures, end structures and floor structures together define a well for receiving a plurality of intermodal cargo containers. The well has a longitudinal direction substantially aligned with a direction of travel of the railroad freight car and a transverse direction substantially normal thereto. The floor structure of the railroad freight car comprises a container support within the well which provides a container support surface. The improvement according to a broad aspect of the present invention comprises a container stop that is provided with the container support, and has an extended position and a retracted position. The container stop is biased to the extended position, the extended position being defined by the container stop extending upwardly from the container support surface to present a stop surface within the well. The stop surface constitutes means for arresting the longitudinal translation of one of the intermodal cargo containers when same is located longitudinally aside the container stop and is seated on the container support surface. The retracted position of the container stop is defined by the container stop being retracted with respect to the container support surface when a cargo container is placed onto the container stop, such that the stop surface is not presented within the well.

With reference to preferred embodiments of the present invention, the container stop presents two stop surfaces within the well for arresting the longitudinal translation of two intermodel cargo containers when same are respectively located longitudinally on each side of the container stop and are respectively seated on the container support surface. A container guide is associated with the container stop. The container guide is provided in a side structure of the railcar. The container guide provides a deflector which extends within the well in the transverse direction. The deflector constitutes means for longitudinally guiding an intermodal cargo container within the well as said container is being placed therein. The deflector is dimensioned and positioned with respect to the container stop so as to prevent both of two intermodal cargo containers from seating onto the container stop together when each of the two intermodal containers is placed in succession within the well of the railroad freight car.

With reference to preferred embodiments of the present invention, the container stop may be supported by a biasing component, with the biasing component being connected to the container support. The container stop and the biasing component may be received within a corresponding receptacle that is provided in the container support for slip fit engagement with the container stop.

Preferably, the container stop is substantially rectangular in cross-section, and provides a substantially planar top surface which is substantially co-planar with the container support surface when the container stop is in the retracted position. The container stop preferably provides two substantially planar and parallel side surfaces which are substantially vertically disposed with respect to the top surface and which respectively define the two stop surfaces of the container stop.

The biasing component for the container stop may be a coil spring. The container stop may be provided in the form of a hollow block.

The container guide preferably provides a bumper surface for laterally guiding an intermodal cargo container in the transverse direction within the well as the intermodal cargo container is being placed therein. The deflector is preferably mounted on the bumper surface and extends therefrom in the transverse direction.

The deflector may be provided with a pre-determined range of longitudinal translation with respect to the container stop. As well, the container guide is preferably moveable between a retracted position, wherein the container guide does not extend into the well of the railroad freight car, to an extended position, wherein the guide extends into the well so as to longitudinally and laterally guide the intermodal cargo container within the well as the container is being placed therein.

Preferably, the deflector comprises two substantially parallel and spaced apart side surfaces. Each of the side surfaces extends from the bumper surface in the transverse direction when the container guide means is in its extended position. The side surfaces each provide a supporting edge for two angled surfaces of the deflector, each of the angled surfaces extending respectively from the supporting edges of the side surfaces. The angled surfaces are joined at a common edge so as to define an inverted V-shaped projection which extends from the bumper surface in the transverse direction when the container guide is in the extended position thereof.

In a preferred embodiment, two container stops and two container guides are provided. The first of the two container stops is located substantially at the longitudinal midpoint of the well and adjacent the first side structure. The second of the two container stops is located laterally opposite and is aligned in the transverse direction with the first container stop and adjacent the second side structure. Each of the two container guides is associated with a respective container stop.

BRIEF DESCRIPTION OF THE DRAWINGS

For purposes of illustration, but not of limitation, preferred embodiments of the present invention will next be described with reference to the following drawings, in which.

DETAILED DESCRIPTION OF THE PREFERRED EMBODIMENTS

Figure 1:
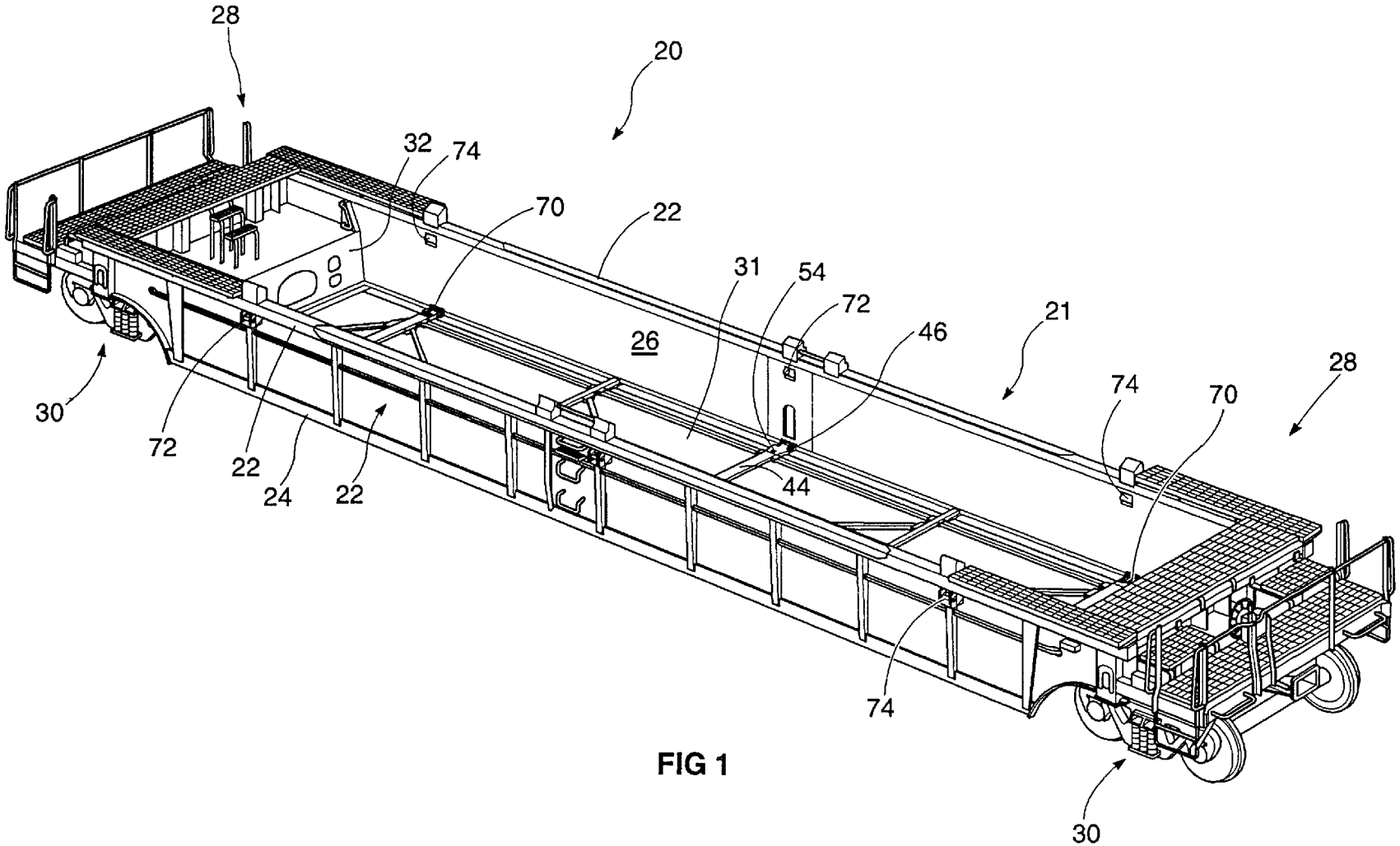
FIG. 1 is a perspective view of a railroad well car which embodies the teachings of the present invention.
Figure 3:
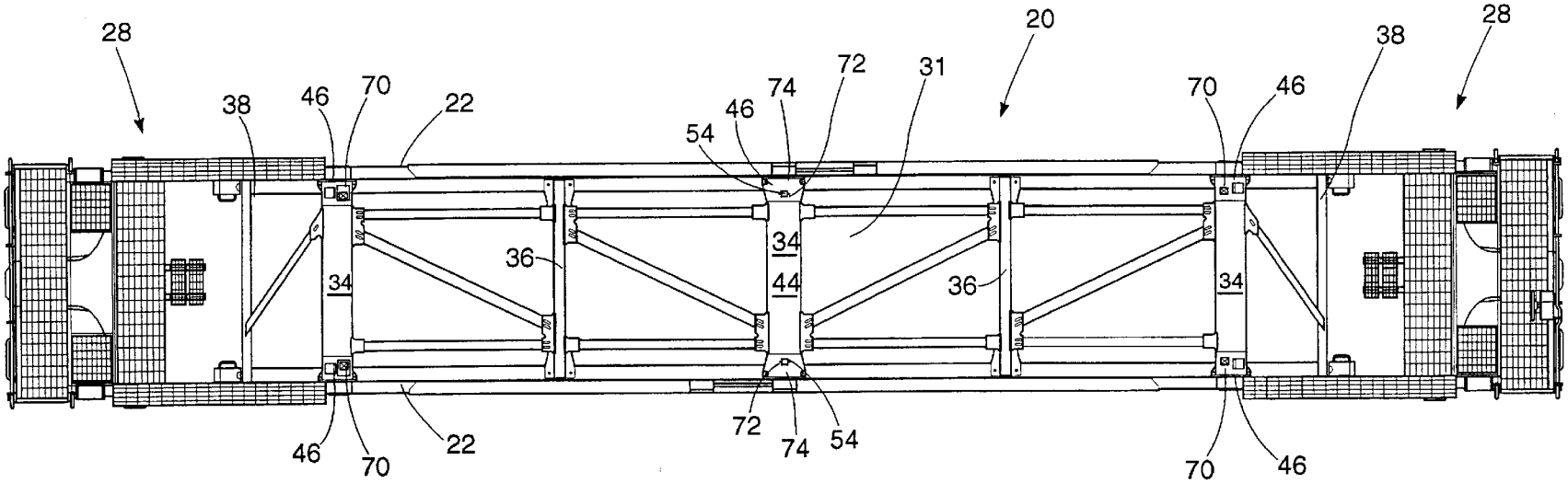
FIG. 3 is a top plan view of the railroad car of FIG. 1.
Figure 2:
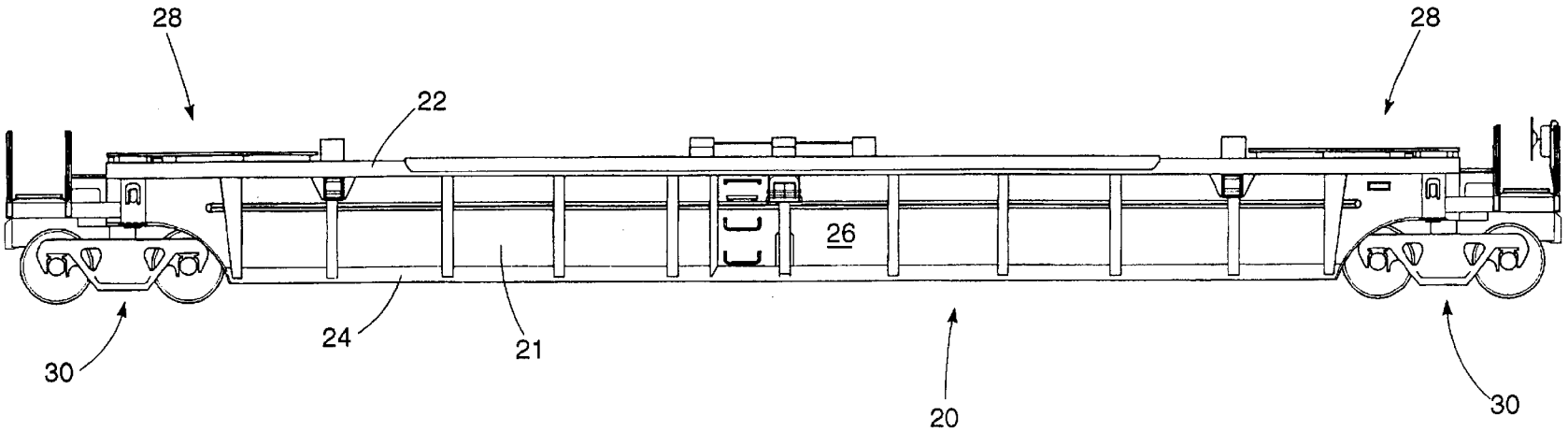
FIG. 2 is a side elevational view of the railroad car of FIG. 1.

A railroad freight car 20 incorporating the present invention and intended for transporting various sizes of intermodal cargo containers is illustrated in FIGS. 1, 2 and 3. Certain aspects of this freight car are constructed in accordance with standard practice, as known to those skilled in this art, in that the car has a longitudinally extending load bearing frame structure formed by spaced apart side structures 21 comprising top side chords 22, bottom side chords 24, and sidewalls 26. The side structures 21 are connected to opposing end structures 28. The frame structure is supported at its ends on wheeled trucks 30 which run on railway tracks (not shown). The side structures 21, inboard bulkheads 32 of the end structures 28 and the floor structure 31 together define a well for receiving intermodal cargo containers.

The floor structure 31 of the well car 20, as illustrated in FIG. 3, extends between parallel spaced apart bottom side chords 24 and comprises load supporting transverse members 34, intermediate transverse members 36 and bulkhead bottom flanges 38. Extending between adjacent transverse members are diagonal struts 40 and diagonal end struts 42 which are arranged in a symmetrical layout about the centre load support transverse member 44.

Figure 4:
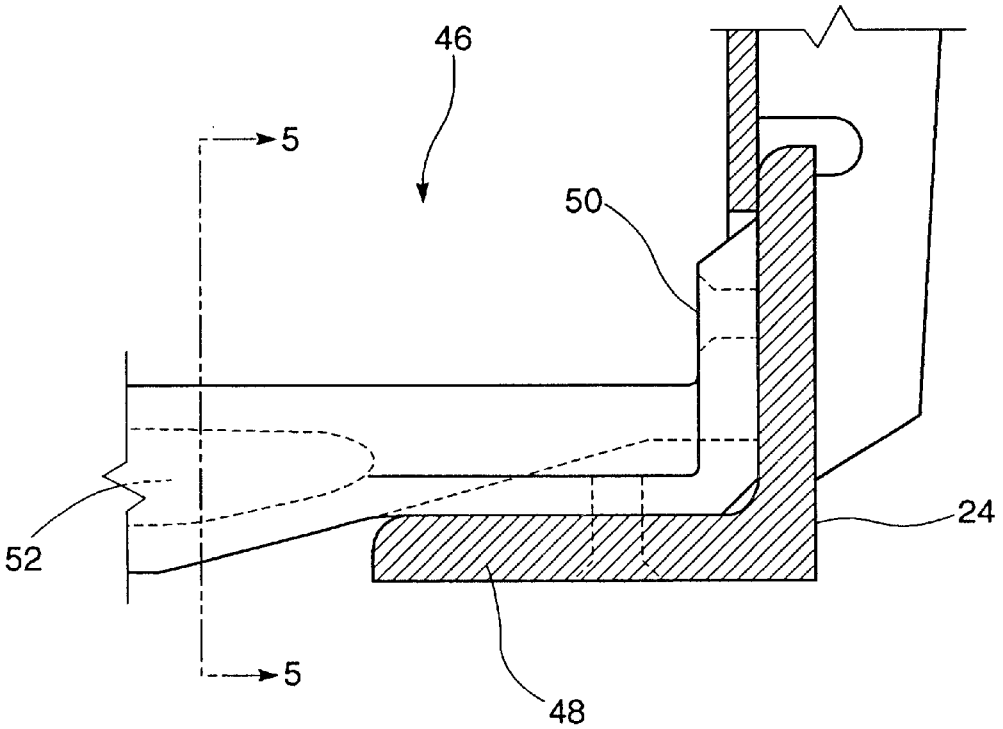
FIG. 4 is a transverse sectional view of the connection between the load supporting transverse member, the container support bracket and the side wall of the railroad car of FIG. 1.
Figure 5:
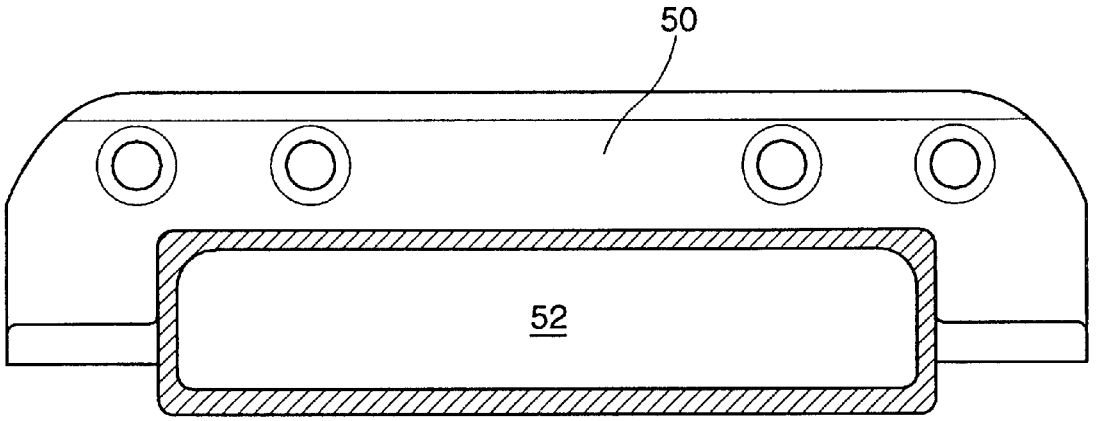
FIG. 5 is a transverse sectional view of the container support bracket of FIG. 4 along the lines 5—5.
Figure 6:
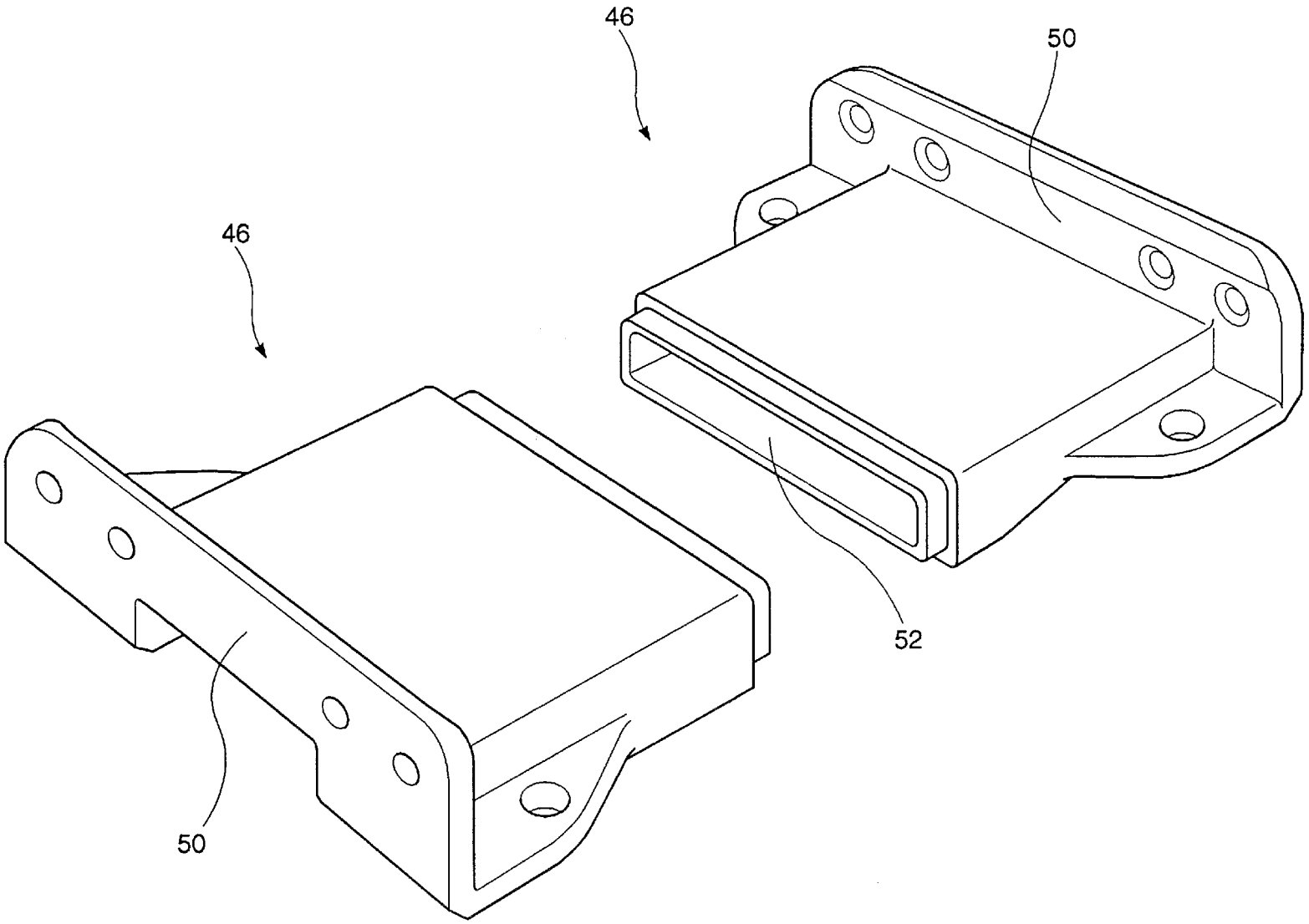
FIG. 6 is a perspective view of a pair of container support brackets for connecting the load supporting transverse members of FIG. 1.

Each of the load supporting transverse members 34 comprises a container support, such as a bracket 46 at each longitudinal end thereof, best shown in FIGS. 4, 5 and 6. The container support bracket 46 is profiled to sit on the horizontal leg 48 of bottom side chord 24, as best shown in FIG. 4. The container support bracket 46 may be affixed to the horizontal leg 48 of bottom side chord 24 by means of bolts or the like.

At the end of container support bracket 46 opposite its upwardly extending flange 50 is a hollow 52, as best shown in FIG. 6. The mouth of the hollow 52 is narrowed to fit inside of load supporting transverse member 34 and to provide backing for a weld joint. Container support bracket 46 may be cast, forged or machined, but is preferably cast. In order to maximize the strength and stiffness of transverse members 34, the container support bracket 46 is of a depth such that the lowermost surface of container support bracket 46 is substantially flush with the bottom surface of the horizontal leg 48 of bottom side chord 24, as shown in FIG. 4.

Figure 7B:
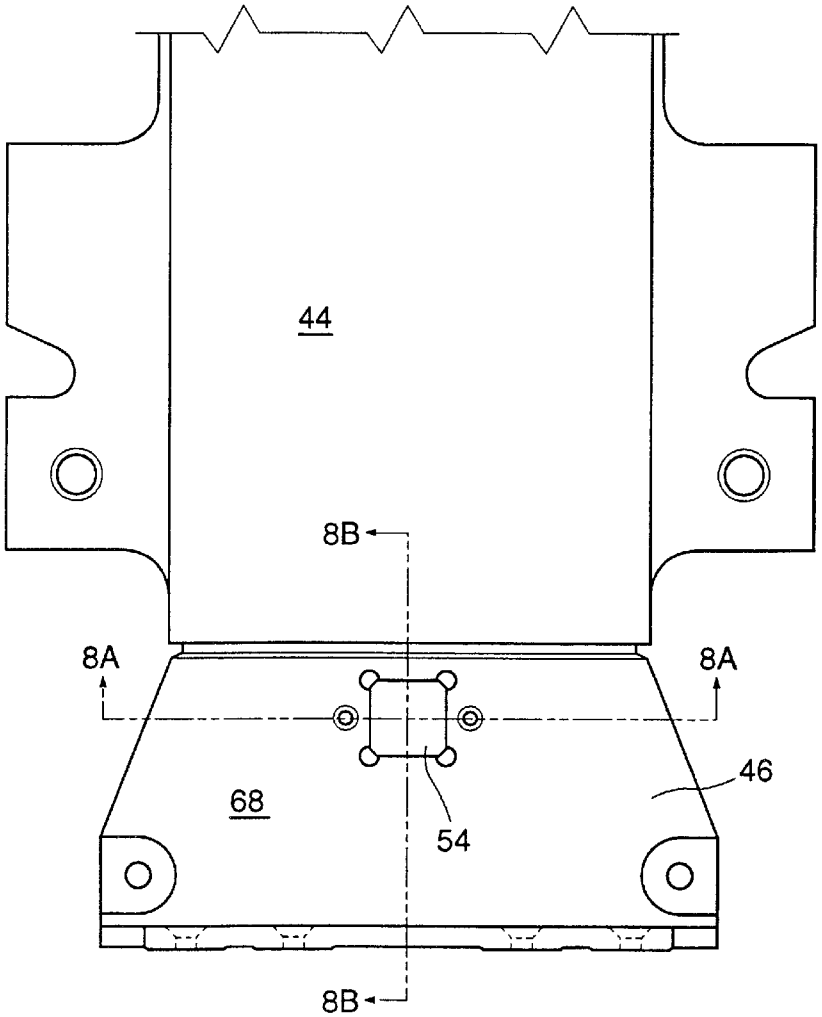
FIG. 7B is a detailed top plan view of one end of the load supporting transverse member of FIG. 7A.
Figure 7A:
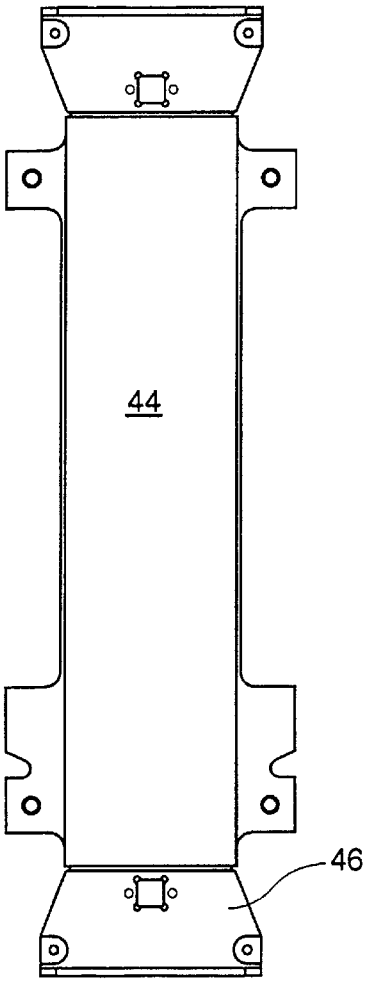
FIG. 7A is a top plan view of a load supporting transverse member connected by container support brackets incorporating the longitudinal stop block of the present invention.
Figure 8A:
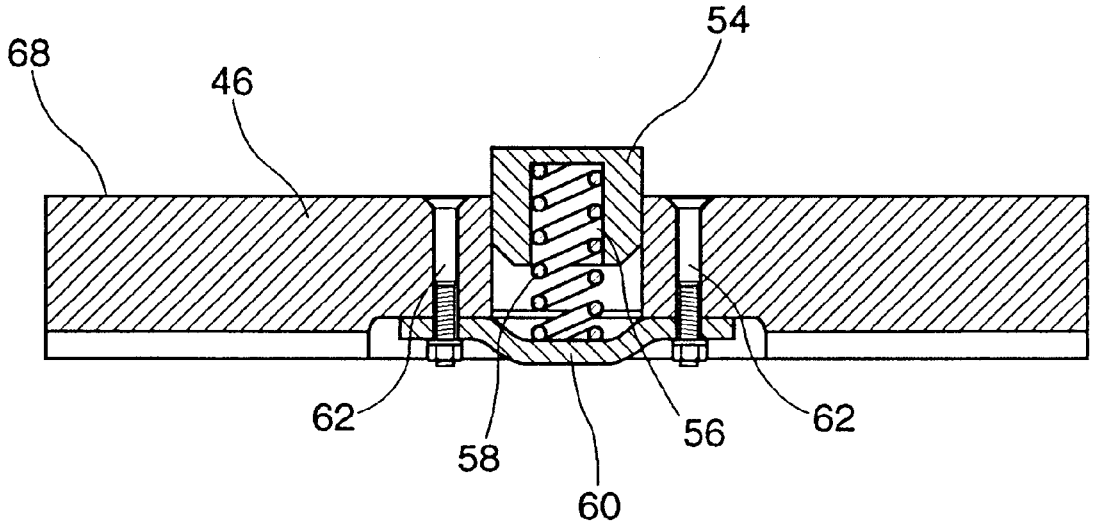
FIG. 8A is a longitudinal sectional view of the container support bracket of FIG. 7B along the lines 8A—8A, illustrating the longitudinal stop block.
Figure 8B:
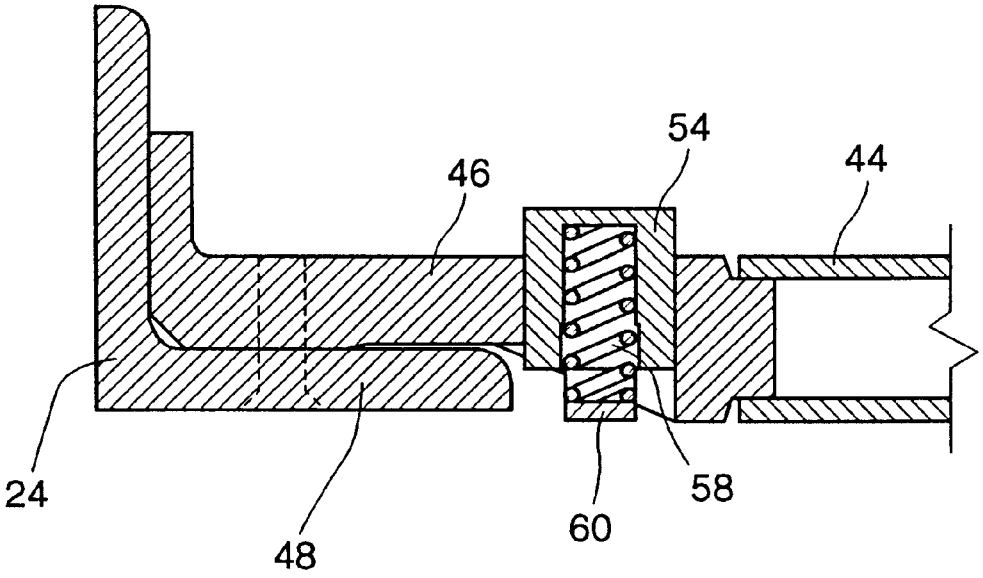
FIG. 8B is a lateral sectional view of the container support bracket of FIG. 7B, along the lines 8B—8B.
Figure 8C:
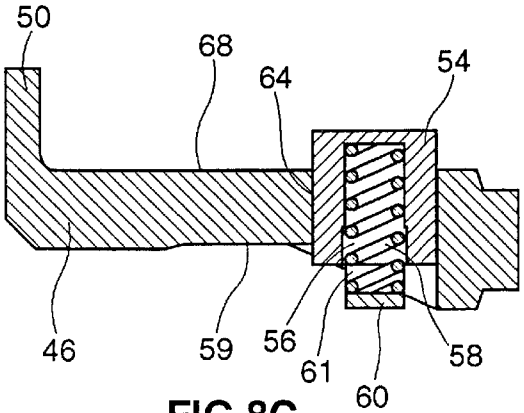
FIG. 8C is a lateral sectional view of the container support is a lateral sectional view of the container support bracket of FIG. 8D, along the lines 8C—8C.
Figure 8D:
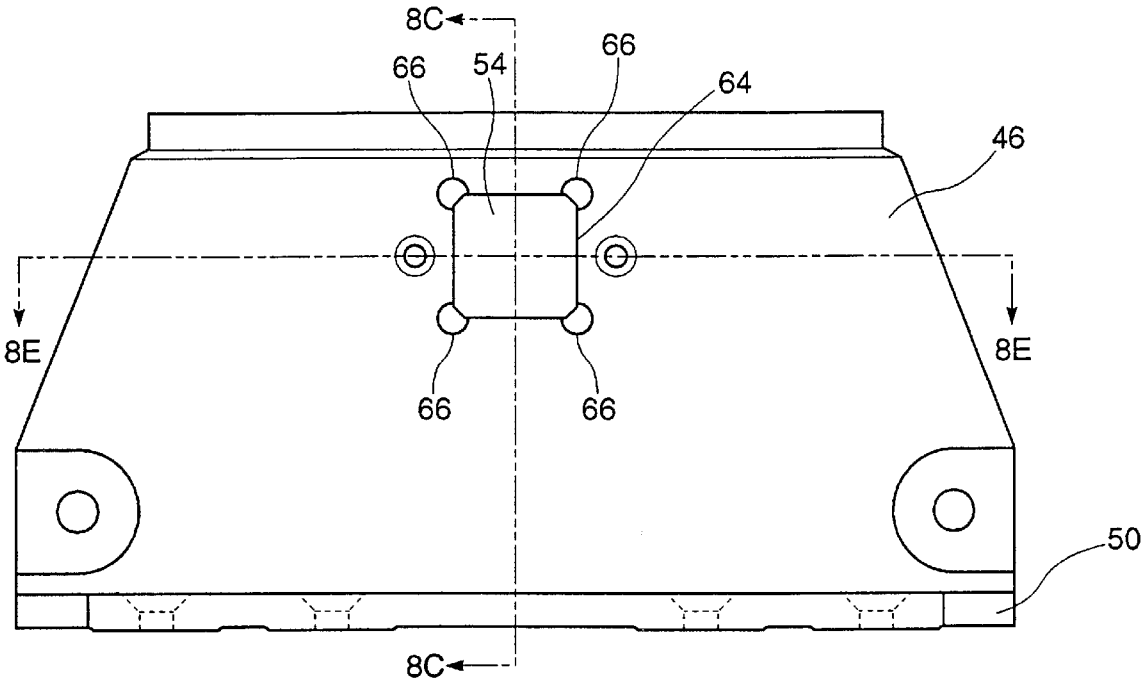
FIG. 8D is a detailed top plan view of the container support bracket of FIG. 7B, without connection to the load supporting transverse member.
Figure 8E:
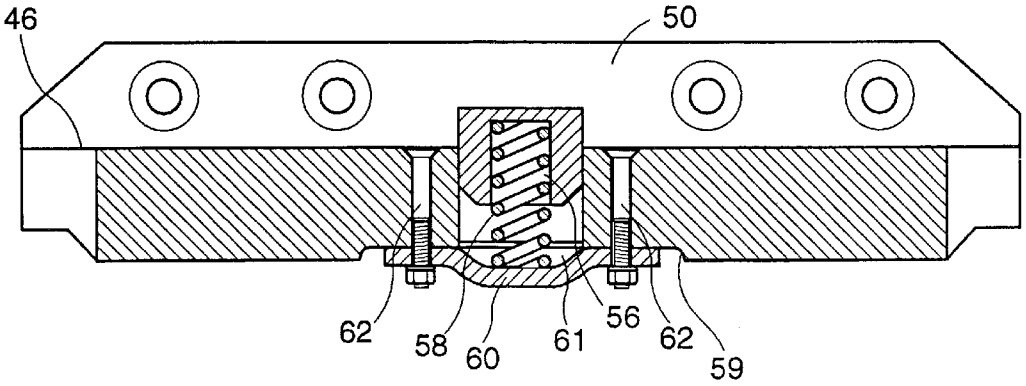
FIG. 8E is a longitudinal sectional view of the container support bracket of FIG. 8D, along the lines 8E—8E.

A first container stop or longitudinal stop block 54 according to the present invention is housed within the container support bracket 46 which is associated with the centre load supporting transverse member 44, as shown in FIGS. 1, 3 and 7B. Likewise, a second longitudinal stop block identical in construction to the first stop block is housed within the container support bracket associated with the other end of centre load supporting transverse member 44. Thus, the second stop block 54 is located laterally opposite to and is aligned in the transverse direction with the first stop block 54. In its preferred embodiment, depicted in FIGS. 8A to 8E, each stop block 54 is a substantially square steel block having a hollow core 56. The hollow core 56 receives a biasing component such as a coil spring 58. The end of coil spring 58 which extends outside of the hollow core 56 of stop block 54 is attached to a bottom support plate 60, which in turn is affixed to the underside 59 of container support bracket 46 by means of threaded fasteners 62 or the like, as shown in FIGS. 8A and 8E. Stop block 54 is positioned in slip fit engagement with a receptacle 64 provided in the container support bracket 46. As shown in FIG. 8D, receptacle 64 provides four through channels 66 which allow for water drainage. Bottom support plate 60 is curved so as to form a gap 61 between it and the underside 59 of container support bracket 46 (FIGS. 8C and 8E) in order to assist with water drainage.

The longitudinal stop block, when assembled in the manner described above within the container support bracket 46, is upwardly biased so as to normally protrude from the upper surface or container support surface 68 of container support bracket 46. Given that the longitudinal stop block 54 is only employed in the preferred embodiment with the container support brackets 46 which are connected to the centre load supporting transverse member 44 of the floor structure, those skilled in the art will appreciate that one 20-foot cargo container may be seated on the floor structure in the well of railcar 20 on each side of the stop block 54.

Figure 9:
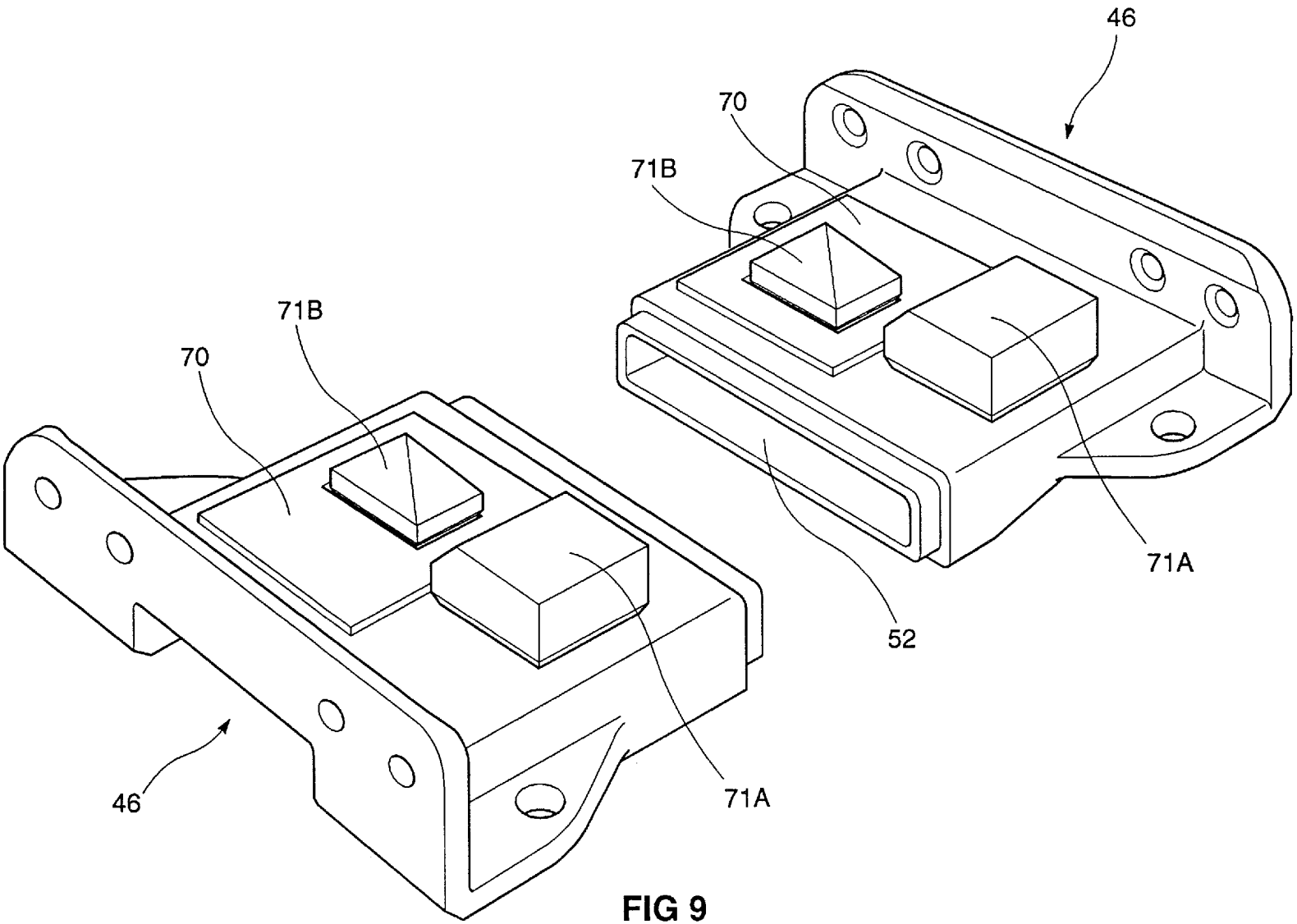
FIG. 9 is a perspective view of a pair of container support brackets for connecting intermediate transverse members of FIG. 1, illustrating a container support assembly comprising a container guide and locating cone.

The container support brackets 46 which are located at either end of the well of the railcar 20 are provided with a container support assembly 70, well-known to those skilled in this art and shown in FIG. 9. The container support assemblies 70 are located with respect to one another and to the container well such that the corner castings of properly placed 40-foot containers will rest upon them. The corresponding structural members in longer containers such as 45-foot, 48-foot or 53-foot containers are not located at the corners of the container, but are located longitudinally inward of the corners so that the castings rest upon the same container support assemblies. Each container support assembly 70 has mounted upon it a container guide 71A and a locating cone 71B. The locating cone 71B is adapted to be received in an opening in a corner casting or a corresponding structural member in a container. The container guide 71A guides the container longitudinally during loading of the container into the well and onto the corresponding locating cone 71B on the container support assembly 70 as is well-known to those skilled in this art.

If a long container, such as a 40-foot container, sits on top of the stop block 54, the long container will depress the block 54 from its upwardly biased or extended position into the container support bracket 46 and will compress the spring 58 therewithin. When the 40-foot or longer container is removed from the well of the railcar 20, spring 58 will translate the stop block 54 upwardly into its extended position.

The stop block 54 preferably works in conjunction with a container guide, for instance a pivotable container guide assembly 72. The pivotable container guide assembly 72 functions in some respects in a manner similar to known adjustable container guides 74, such as the type which have been described in U.S. Pat. No. 5,501,556, issued on Mar. 26, 1996 in the names of Butcher et al., and in U.S. Pat. No. 5,520,489, issued on May 28, 1996 in the names of the same inventors. Each of these patents has been assigned to the present Applicant. Those skilled in the art will appreciate that adjustable container guide assemblies 74 are employed to accommodate the width variation of standard cargo containers. The adjustable container guides 74 are located in the side structures of railcar 20, as shown in FIG. 1.

The known container guides are slidable between a retracted position in which the container guides 54 do not protrude into the well of the railcar 20 and an extended position in which a portion of the guide projects beyond its housing in the side structure of a railcar and into the well of the railcar 20. When the guides are in their retracted position, the guides do not protrude beyond the inside surface of the side sheets of the railcar. The inside width of a typical well car from side sheet to side sheet is 8'8". Thus, in their retracted position, the guides allow for the well to accommodate the wider containers, such as standard 45-foot containers which have a width of 8'6". On the other hand, when the guides are in their extended positions, a portion thereof extends into the well, effectively reducing the width of the well. When such guides are employed in their extended position, the effective width of the well is reduced to approximately 8'1". Such a width is suitable for accommodating containers having a narrower width, such as standard 20 foot containers which have a width of 8'0". In their extended position, the adjustable container guides make narrow containers less prone to sideways tipping during transport. This may be especially prevalent when the containers are in a double-stacked configuration and empty in high wind environments. When adjustable container guides 74 of the known construction are extended within the railcar well, the guides also assist in guiding the containers over the container locating cones of the container support assemblies 70.

Figure 10C:
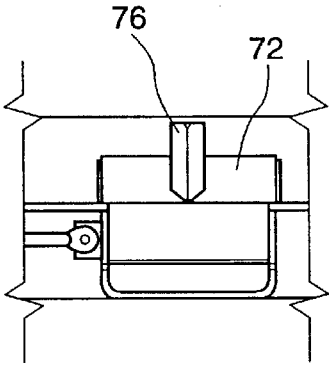
FIG. 10C is a top plan view of the side wall of FIG. 10B.
Figure 10A:
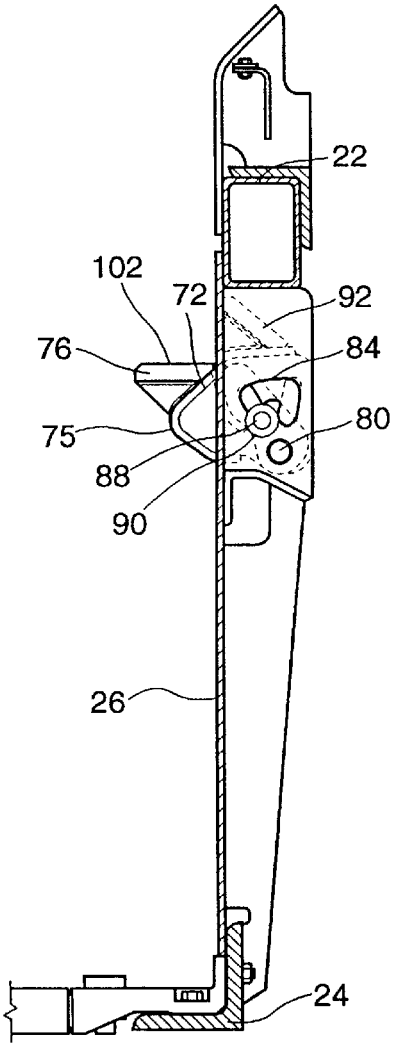
FIG. 10A is a transverse sectional view of the side wall of the railcar incorporating the longitudinal stop block and container guide assembly of the present invention in its extended position in solid lines and in its retracted position in phantom lines.
Figure 10B:
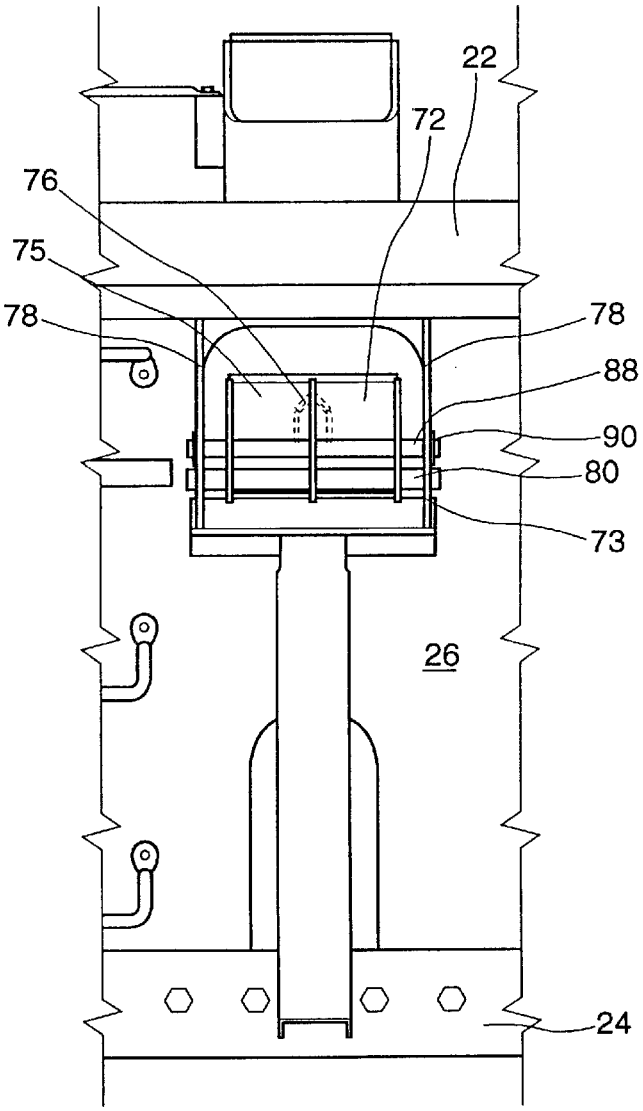
FIG. 10B is an elevational view of the side wall of the railcar of FIG. 1 illustrating the container guide assembly in its extended position.

As previously stated, the container guide assembly 72 according to the present invention shown in FIGS. 10A, 10B and 10C functions in some respects in a manner similar to the known container guide described above. Container guide assembly 72, however, provides an additional feature, namely a deflector 76 whose function is described in greater detail herebelow. The adjustable container guide assembly 72 is mounted within an aperture in the side structure of the railcar, as is best illustrated in FIG. 10B. Adjustable container guide assembly 72 comprises a housing 73 and a pivotally mounted guide 75. Housing 73 has two parallel support walls 78. Each support wall 78 has a matching inverted U-shaped slot 84.

Container guide assembly 72 has a pivot pin 80 which pivotally connects guide 75 to housing 73. Guide 75 has side walls 94 connected by a curved bumper surface 96. Such side wall 94 has a linear slot 86 radially extending from the axis of rotation of pivot pin 80. Linear slot 86 corresponds to U-shaped slot 84 in each support wall 78. Slots 84 and 86 are sized to slidably receive handle rod 88 which extends outwardly from guide 75. Handle rod 88 is maintained in position by means of washers 90 or the like fixed to each end of the handle rod 88. Handle rod 88 slidingly engages U-shaped slot 84 in a cam relationship.

Curved bumper surface 96 presents deflector 76 extending therefrom. Deflector 76 presents two angled top surfaces 98 and two substantially parallel and spaced apart side surfaces 100 which are in turn parallel to side walls 94 of guide 75. Each side surface 100 extends from bumper surface 96 in the transverse direction when guide 75 is in its extended position within the container well. Each side surface provides a supporting edge 100A. Each angled top surface 98 extends from the supporting edges 100A. Angled top surfaces 98 join at a common edge 102 so as to define an inverted V-shaped projection which extends from the bumper surface 96 in the transverse direction when the guide 75 is in the extended position.

In use, an operator can grasp handle rod 88 when the container guide assembly 72 is in either of its extended or retracted positions. The operator slides the handle rod 88 relative to the position of the pivot pin 80 while urging the handle rod to travel within the inverted U-shaped slot 84 in a cam relationship. For instance, when the container guide assembly 72 is in its extended position within the container well, the operator urges handle rod 88 upwardly and outwardly of the side wall to thereby cause the guide 75 to pivot upwardly and outwardly so that the container guide assembly 72 is moved to a retracted position within the support walls 78. This retracted position of the container guide assembly 72 is shown in phantom lines in FIG. 10A by reference numeral 92. Once the retracted position has been achieved, the operator lowers handle rod 88 so as to settle it within the outwardly disposed leg of the inverted U-shaped slot 84. In order to deploy the container guide assembly 72 into its extended position, the procedure outlined above is reversed.

Figure 11B:
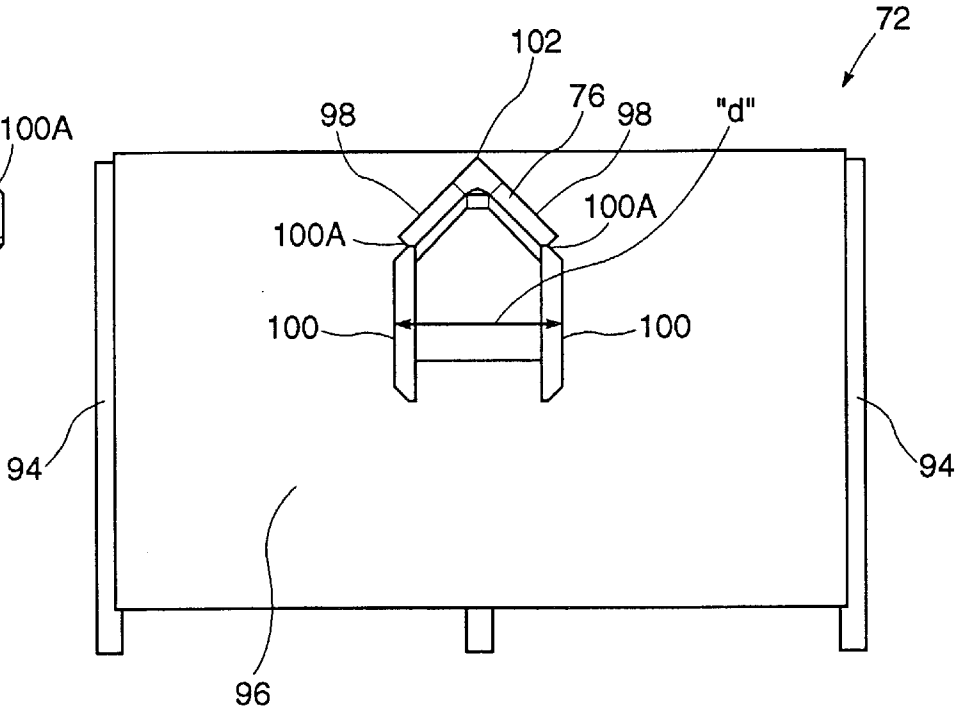
FIG. 11B is a detailed view of the container guide assembly shown in FIG. 10C.
Figure 11A:
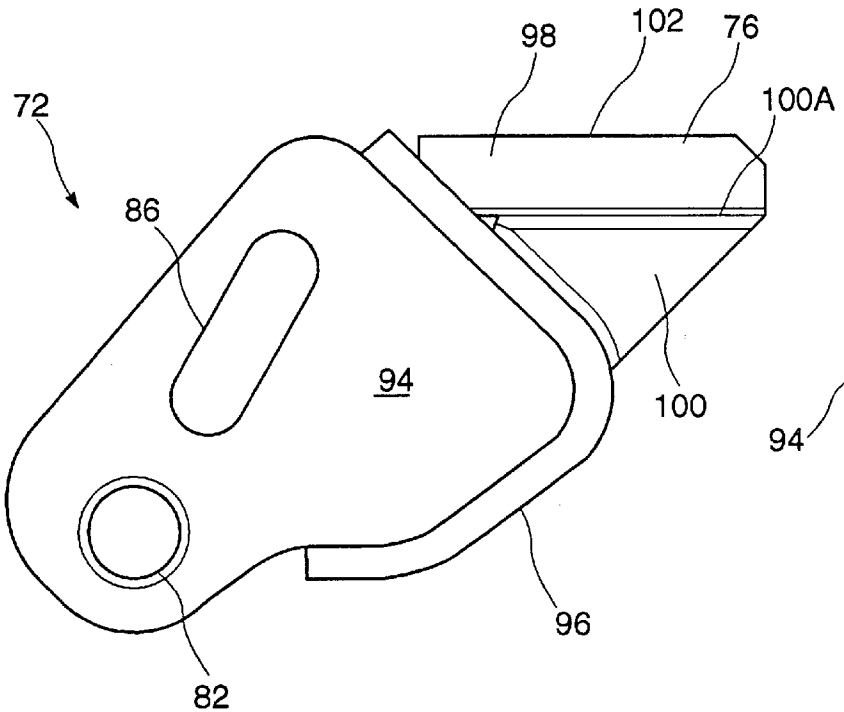
FIG. 11A is a side elevational view of the guide portion of the container guide assembly.

Container guide assembly 72 is positioned within the sidewall structure of railcar 20 such that when container guide assembly 72 is deployed into its extended position within the well of the railcar, the deflector 76 will be positioned to extend laterally within the well space and will be oriented so that the common edge 102 of angled top surfaces 98, as shown in FIGS. 10A and 11A, is substantially parallel to a plane containing the floor structure 31 of the railcar. As well, when container guide assembly 72 is in its fully extended position, the common edge 102 of deflector 76 extends in a direction substantially transverse to top side chords 22 and bottom side chords 24 of the railcar 20. Guide 75 is positioned within the sidewall structure of the railcar such that the guide is permitted to slide longitudinally within its housing about a centred position as explained below. In the centred position, common edge 102 of deflector 76 is laterally aligned with the position of the longitudinal stop block 54 located immediately adjacent and below the guide 75. Thus, the deflector 76 has a centred position that is aligned with stop block 54 in a vertical plane which contains common edge 102 of the angled top surfaces 98 of the deflector and a centerline which bisects the stop block 54.

In use, the container guide assembly 72 works in conjunction with the stop block 54 as follows. As those skilled in this art will appreciate, the corner castings of standard cargo containers have longitudinal slots located therein. These slots are dimensioned so as to give a generous clearance between the slot of the corner casting and the locating cones 71B of a container support assembly 70. This means that when the first of two 20-foot containers is placed in the well of the railcar a top the locating cones 71B, the clearance provided by the corner casting slots may result in the container coming to rest on top of the stop block 54. As well, the container guide assembly 72 is pivotally located within its support walls 78 by means of pivot pin 80, previously described. Preferably, the pivot pin 80 will be made long enough to provide the container guide 75 with the ability to translate in a longitudinal direction over the pin 80 plus or minus 1.5 inches to either side of its centred position. The guide 75 is preferably pivotally connected to its support wall 78 in this way so it does not have to resist the very high longitudinal loads which may be generated by container pitching. The fact that the container guide 75 will be mounted to its support wall 78 in this manner makes it less likely that the deflector 76 will act to prevent a first container from seating itself on top of the longitudinal stop block 54.

When the second 20-foot container is placed into the well of the railcar 20, the container will be deflected by the deflector 76, which is dimensioned so as to cause the second container to seat itself on the floor structure 31 and clear the edge of the stop block 54. However, as explained above, the first 20-foot container placed into the well will likely be seated over the stop block 54. When the car will be pulled in a train, it will initially be subjected to minor longitudinal accelerations and decelerations which will serve to cause the containers to slide longitudinally back and forth. Given that the deflector 76 will maintain a 3.75" gap between the two containers, such minor longitudinal movements will allow the block 54 to be driven to its fully extended position as the first container clears the edge of the block 54. Once the block has extended itself in this manner, it will act to prevent any further longitudinal shifting of the two containers within the well. It is expected that the proper extension of the longitudinal stop block 54 will occur in this manner before the railcar is subjected to more severe inertial and dynamic loading at higher speeds.

Preferably, the stop block is dimensioned with a 3"×3" square cross-sectional area. The width dimension "d" in the longitudinal direction of the deflector 76 is preferably 3.75". As previously explained, the deflector is intended to separate two 20-foot containers during their placement into the well so that at least one of the containers will sit aside of the stop block 54.

Those persons skilled in this art will readily appreciate that various modifications of detail may be made to the preferred embodiment discussed and illustrated herein, all of which come within the spirit and scope of the present invention.

What is claimed is:

1. A railroad freight car for transporting intermodal cargo containers, the railroad freight car comprising spaced apart first and second side structures, opposed end structures and a floor structure, such that the side structures, end structures and floor structure together define a well for receiving a plurality of said intermodal cargo containers, the well having a longitudinal direction substantially aligned with a direction of travel of the railroad freight car and a transverse direction substantially normal thereto, the floor structure of the railroad freight car comprising a container support within said well which provides a container support surface, the container support surface including a container stop having an extended position and a retracted position, the container stop being biased to the extended position thereof, the extended position being defined by the container stop extending upwardly from the container support surface to present at least one stop surface within the well, the stop surface having means for arresting the longitudinal translation of one of the intermodal cargo containers when the intermodal cargo container is located longitudinally aside of the container stop and is seated on the container support surface, the retracted position being defined by the container stop being retracted with respect to the container support surface such that said at least one stop surface is not presented within the well, said container stop being moved under the weight of the intermodal cargo container to said retracted position when the intermodal cargo container is placed completely over the entirety of said container stop.

2. The freight car according to claim 1, wherein said container stop presents two stop surfaces within the well, each of said stop surfaces having means for arresting the longitudinal translation of an intermodal cargo container when said cargo containers are located longitudinally to either side of the container stop and is sealed on the container support surface.

3. The invention according to claim 1, wherein the container stop is substantially rectangular in cross-section, the container stop providing a substantially planar top surface which is substantially co-planar with the container support surface when said container stop is in the retracted position thereof, the container stop further providing two substantially planar and parallel side surfaces which are substantially vertically disposed with respect to the top surface and which respectively define said two stop surfaces.

4. The invention according to claim 1, wherein the container stop is a hollow block.

5. In a railroad freight car for transporting intermodal cargo containers, the railroad freight car comprising spaced apart first and second side structures, opposed end structures and a floor structure, such that the side structures, end structures and floor structure together define a well for receiving a plurality of said intermodal cargo containers, the well having a longitudinal direction substantially aligned with a direction of travel of the railroad freight car and a transverse direction substantially normal thereto, the floor structure of the railroad freight car comprising a container support within said well which provides a container support surface, the improvement comprising a container stop provided with the container support, the container stop having an extended position and a retracted position, the container stop being biased to the extended position thereof, the extended position being defined by the container stop extending upwardly from the container support surface to present two stop surfaces within the well for arresting the longitudinal translation of an intermodal cargo container when the container is located longitudinally aside of either container stop surface and is seated on the container support surface, the retracted position being defined by the container stop being retracted with respect to the container support surface when the intermodal cargo container is placed onto said container stop, such that the stop surface is not presented within the well; and a container guide associated with the container stop, the container guide being provided in one of said side structure structures, the container guide providing a deflector which extends within the well in the transverse direction, the deflector constituting means for longitudinally guiding an intermodal cargo container within the well as said container is being placed therein; and wherein said deflector is dimensioned and positioned with respect to said container stop so as to prevent both of two intermodal cargo containers from sealing onto the container stop together when each of said two intermodal cargo containers is placed in succession within the well of the railroad freight car.

6. The invention according to claim 5, wherein said container stop is supported by a biasing component for biasing the container stop to said extended position, the biasing component being connected to the container support, the container stop and the biasing component being received within a corresponding receptacle that is provided in the container support for slip-fit engagement with said container stop.

7. The invention according to claim 6, wherein said biasing component is a coil spring.

8. The freight car according to claim 5, wherein the container guide provides a bumper surface thereon for laterally guiding the intermodal cargo container in the transverse direction within the well as the intermodal cargo container is being placed therein, the deflector being mounted on the bumper surface and extending therefrom in the transverse direction.

9. The invention according to claim 8, wherein the deflector has a pre-determined range of longitudinal translation with respect to the container stop.

10. The invention according to claim 8, wherein the container guide is moveable between a retracted position, wherein the container guide does not extend into the well of the railroad freight car, to an extended position, wherein the container guide extends into said well so as to longitudinally and laterally guide an intermodal cargo container within the well as said container is being placed therein.

11. The invention according to claim 10, wherein the deflector comprises two substantially parallel and spaced apart side surfaces, each of which extends from the bumper surface in the transverse direction when said container guide is in the extended position thereof, said side surfaces each providing a supporting edge, the deflector further comprising two angled surfaces, each respectively extending from the supporting edges of the side surfaces, said angled surfaces being joined at a common edge so as to define an inverted V-shaped projection which extends from the bumper surface in the transverse direction when said container guide is in the extended position thereof.

12. The invention according to claim 5, wherein two container stops and two container guides are provided, the first of said two container stops being located substantially at the longitudinal midpoint of the well and adjacent the first side structure, the second of said two container stops being located laterally opposite and aligned in the transverse direction with the said first container stop and adjacent the second side structure, each of said two container guides being associated with a respective container stop.

* * * * *